US006272855B1

(12) United States Patent
Leonardi

(10) Patent No.: US 6,272,855 B1
(45) Date of Patent: Aug. 14, 2001

(54) TWO CYCLE HEAT ENGINE

(76) Inventor: Joseph Leonardi, 50 Hickory St., Bridgeport, CT (US) 06610

( * ) Notice: Subject to any disclaimer, the term of this patent is extended or adjusted under 35 U.S.C. 154(b) by 0 days.

(21) Appl. No.: 09/592,628

(22) Filed: Jun. 13, 2000

(51) Int. Cl.[7] ..... F01B 29/00
(52) U.S. Cl. ..... 60/513; 60/514
(58) Field of Search ..... 60/508, 514, 512, 60/513

(56) References Cited

U.S. PATENT DOCUMENTS

| | | | | |
|---|---|---|---|---|
| 3,599,425 | * | 8/1971 | Lewis | 60/514 |
| 3,956,894 | * | 5/1976 | Tibbs | 60/513 X |
| 4,077,214 | * | 3/1978 | Burke, Jr. et al. | 60/514 X |
| 4,220,005 | * | 9/1980 | Cutts | 60/514 |
| 5,035,115 | * | 7/1991 | Ptasinski | 60/514 X |
| 5,983,640 | | 11/1999 | Czaja . | |

* cited by examiner

*Primary Examiner*—Hoang Nguyen
(74) *Attorney, Agent, or Firm*—Fattibene & Fattibene; Paul A. Fattibene; Arthur T. Fattibene

(57) ABSTRACT

A heat engine having two stages, a first low temperature chamber and a second high temperature chamber. A low boiling point liquid or solution is heated in a first low temperature chamber to slightly above the boiling point. A second high temperature chamber having electric heating coils therein is injected with the returned condensed liquid at predetermined times causing a high vapor pressure driving a piston. The expanding vapor or gas is returned though an exhaust port and condensed by a cooling chamber to be returned to the solution or liquid reservoir. The piston is used to do work and may be coupled to a generator. Different piston configurations may be used. The heat engine of the present invention has the advantage of using a relatively low boiling point liquid, which may be heated by a variety of fuel sources, including solar energy. The invention has a relatively quick response time as a result of the second high temperature chamber. The heat engine can be used to drive any number of machines or device efficiently using relatively low temperatures.

13 Claims, 4 Drawing Sheets

TWO CYCLE HEAT ENGINE

FIELD OF THE INVENTION

The present invention relates in general to a heat engine and, and more particularly to a two stage heat engine using a low boiling point liquid.

BACKGROUND OF THE INVENTION

There are many different types of heat engines. One heat engine is disclosed in U.S. Pat. No. 5,983,640 entitled "Heat Engine" and issuing to Czaja on Nov. 16, 1999. Therein disclosed is an open cycle heat engine using an air-steam mixture. Most engines typically use water that is converted into steam. Water boils at about one hundred degrees centigrade or two hundred and twelve degrees Fahrenheit at sea level atmospheric pressure. The steam produced by boiling water is often used to drive a piston. However, general relativity high heat is required to boil water. Additional the high temperature water may cause corrosion in many parts of the engine. Additionally, such engines are not as efficient as they could be. Additionally, there is often a delay in heating the water, which causes the engine to respond slowly. Therefore there is a need for a lower temperature faster response heat engine.

SUMMARY OF THE INVENTION

The present invention relates to a two stage heat engine that uses a low boiling point liquid heated at a first stage or chamber and liquid injected into the higher temperature second stage or chamber causing rapid vaporization of the liquid. The vapor expands and drives a piston in a cylinder. The piston is connected by a rod and a crank to a flywheel, which turns a generator. Detectors sense the position of the piston and open a port when the piston has traveled to its fullest extent causing exhausted vapor to be condensed and returned to the first chamber. A portion of the returned condensed liquid is used for injection into a second high temperature chamber. A low boiling point liquid such as freon, alcohol, or ether may be used. By freon it is meant one of a group of polyhalogenated derivatives of methane and ethane containing fluorine and, in most cases, chlorine or bromine.

Accordingly it is an object of the presence invention to provide an efficient heat engine.

It is another object of the present invention to use a relatively low temperature heat source in the first chamber.

It is an advantage of the present intention that it responses relatively quickly.

It is another advantage of the present invention that it uses a relatively low temperature heat source.

It is a feature of the presence invention that a second high temperature heat chamber is used.

It is another feature of the present intention that a low boiling point liquid is used.

These and other objects, advantages, and features will become readily apparent in view of the following description.

DETAILED DESCRIPTION OF THE PREFERRED EMBODIMENTS

Figure 1:
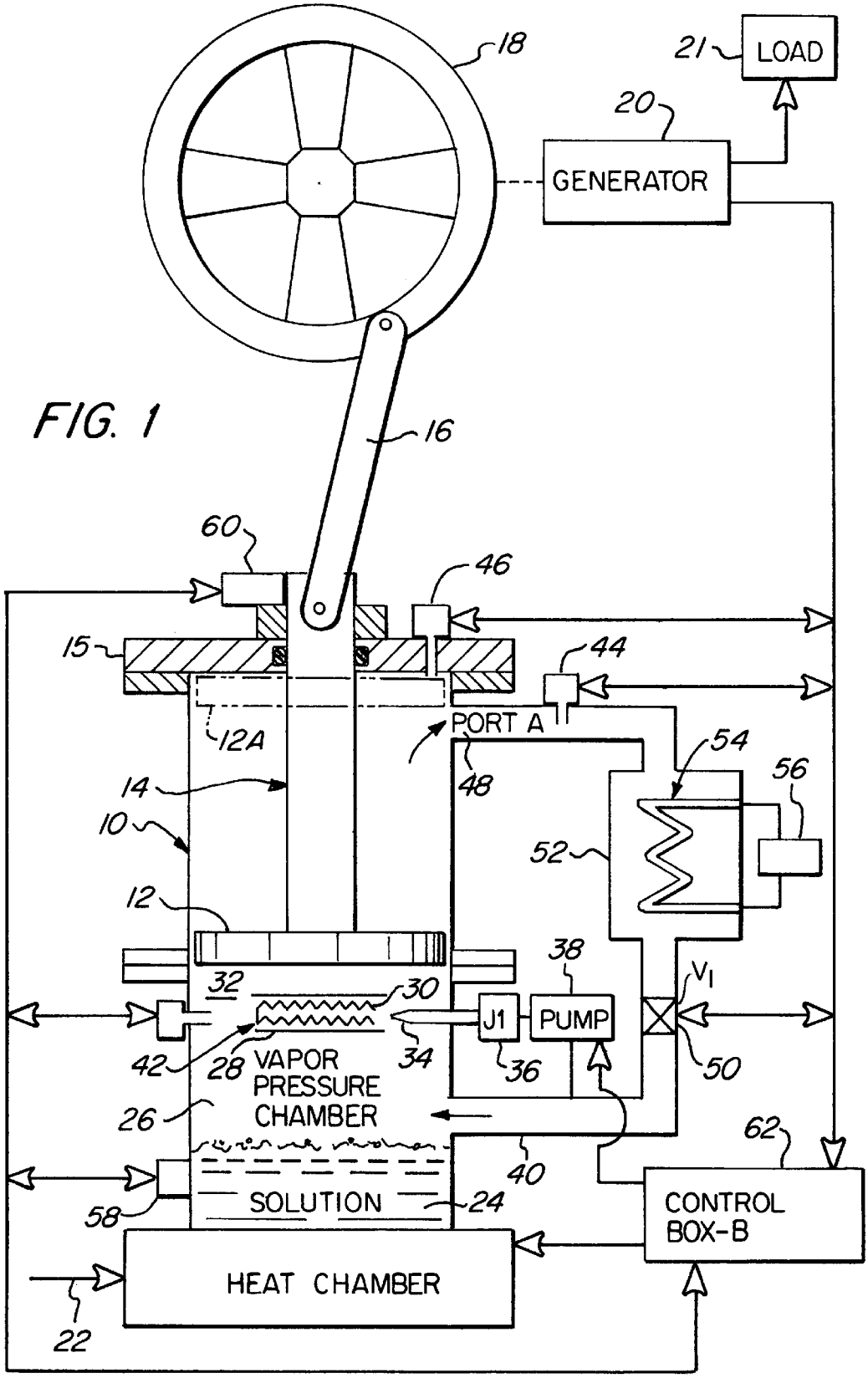
FIG. 1 schematically illustrates the presence invention.

FIG. 1 schematically illustrates the heat engine of the present invention. A cylinder 10 contains a piston 12 having a rod 14 connected thereto. Rod 14 is pivotally connected to a crank, which in turn is connected to a flywheel 18. Flywheel 18 is connected to a generator 20. Generator 20 may be connected to a load 21. The load 21 may be any system or equipment that needs electricity to run. Placed within the bottom portion of cylinder 10 is a heat chamber 22. The heat chamber 22 is used to heat a solution or liquid 24. The solution or liquid 24 preferably has a low boiling point. By low boiling point it is meant a temperature less than one-hundred degrees Celsius or two hundred and twelve degrees Fahrenheit. The heat chamber 22 may be heated by any means such as solid, liquid, or gas fuels that are burned. The heat chamber 22 may also be heated by solar energy. The heat chamber 22 is a low temperature chamber that heats the liquid 24, which may be a mixture of two or more liquids, to a temperature slightly above the boiling point of the liquid 24. Vapor from the heating of the liquid 24 is formed in the vapor pressure chamber 26. A second high temperature chamber 28 has electric coils 30 therein. A nozzle 34 is connected to injector 36, which is connected to a pump 38, which is connected to return tube 40. Return tube 40 contains condensed liquid 24. Liquid 24 maybe controllably injected into the second high temperature chamber 28. Heat chamber 22 raises the temperature of the solution or liquid 24 slightly above the boiling point. Low-pressure vapor enters vapor pressure chamber 26. When work is desired to be performed a portion of a liquid or solution is taken from the return tube 40 and is injected into the high temperature heat chamber 28. The high temperature heat chamber 28 creates a high temperature causing high vapor pressure and expansion of the vapor into expansion chamber 32. The piston 12 is caused to move upward within the cylinder 10.

High-pressure sensor 42, detects the high vapor pressure. The expanding vapor enters the expansion chamber 32 driving the piston 12 upward within the cylinder 10 causing the movement of the flywheel 18. Cylinder top 15 has a cylinder top position sensor 46. Cylinder top position sensor 46 detects the piston 12 when it advances to the uppermost position, shown in phantom at 12A. The vapors are then caused to enter the exhaust port 48. Low-pressure sensor 44 detects the low pressure. Cooling chamber 52 has cooling coils 54 therein. A cooling fluid is pumped through the cooling coils 54 by pump 56. The cooling coils 54 cause the exhaust vapor to condense into a liquid 24. The condensed liquid drains into the vapor chamber 26 through return tube 40. The piston 12 is then caused to return to the bottom position starting another cycle. The position of the piston 12 is detected by the piston bottom position sensor 60. The temperature sensor 58 monitors the temperature of the liquid 24. The entire system is controlled by electronic control 62, which is coupled to the heat chambered 22, the temperature sensor 58, the high pressure sensor 42, the piston position sensor 60, the pump 38, the low pressure sensor 44, the top piston position sensor 46, the valve 50, and the generator 20.

The operation of the present invented can readily be appreciated with reference to FIG. 1. Flywheel 18 provides rotational energy to generator 20. The purpose of the flywheel 18 is to absorb any extra load imparted to the system. The use of the secondary high temperature chamber 28 results in a relatively fast acting heat engine. Exhaust vapor is caused to enter exhaust port 48 when the piston 12 has reached the uppermost position shown as piston location 12A in phantom. The exhaust vapors are condensed by passing through cooling chamber 52, and returned to the vapor pressure chamber 26 by return tube 40. The cycle is thereby repeated continuous forming an efficient quick reacting heat engine that utilizes a relatively low boiling point fluid or solution 24. Accordingly, the heat engine of the present invention can utilize different liquids that boil at relatively low temperatures, at least less than that of water or about two hundred and twelve degrees Fahrenheit or one hundred degrees Celsius.

Figure 2:
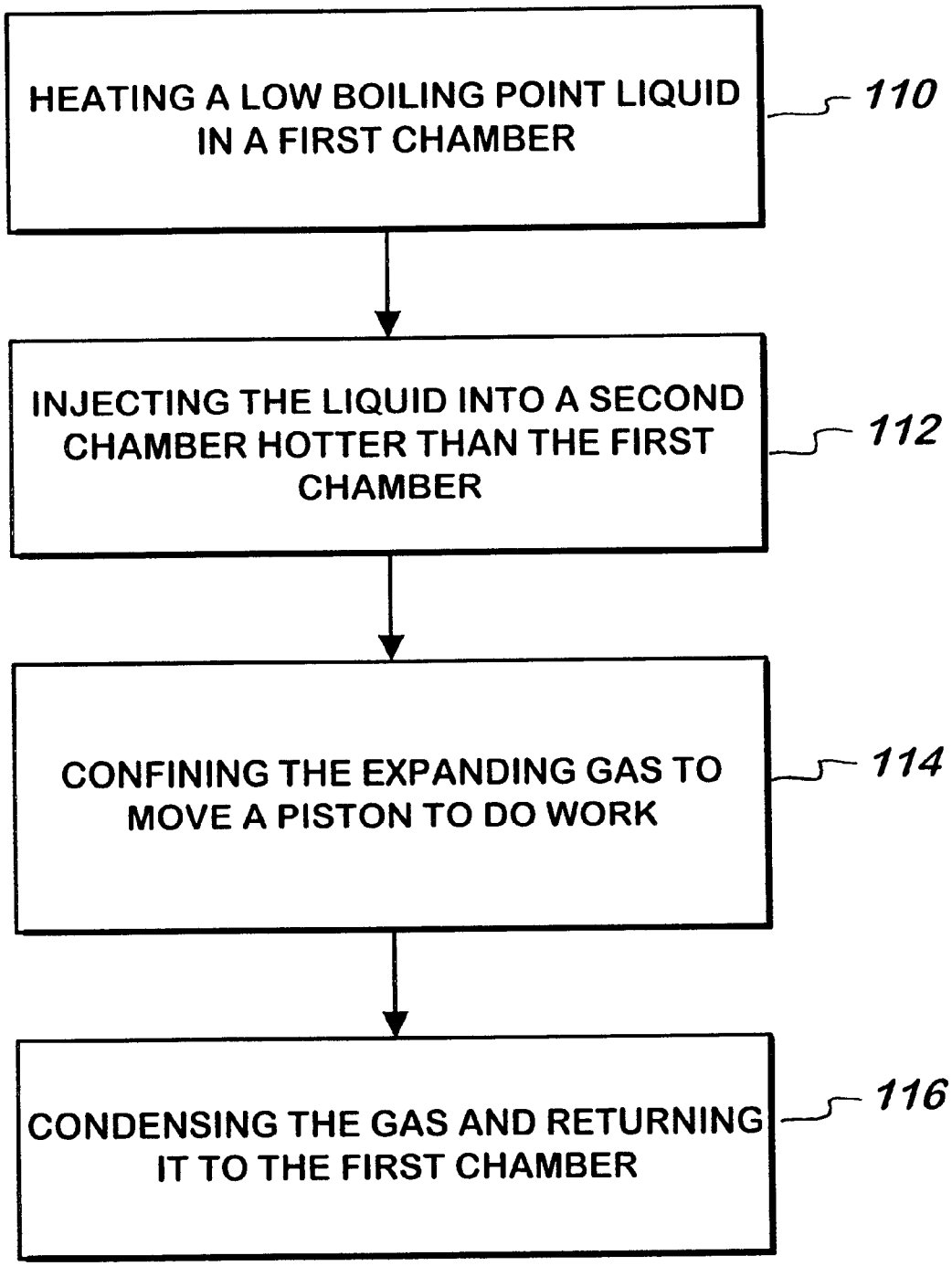
FIG. 2 is a block diagram illustrating the process steps of the present invention.

FIG. 2 is a block diagram illustrating the method or process steps of the present invention. Block 110 represents heating a low boiling point liquid, having a boiling point at one atmosphere of less than one hundred degrees Celsius, in a first chamber. Block 112 represents injecting the liquid into a second chamber hotter than the first chamber. Block 114 represents confining the expanding gas to move a piston to do work. Block 116 represents condensing the vapor or gas and returning it to the first chamber.

Figure 3:
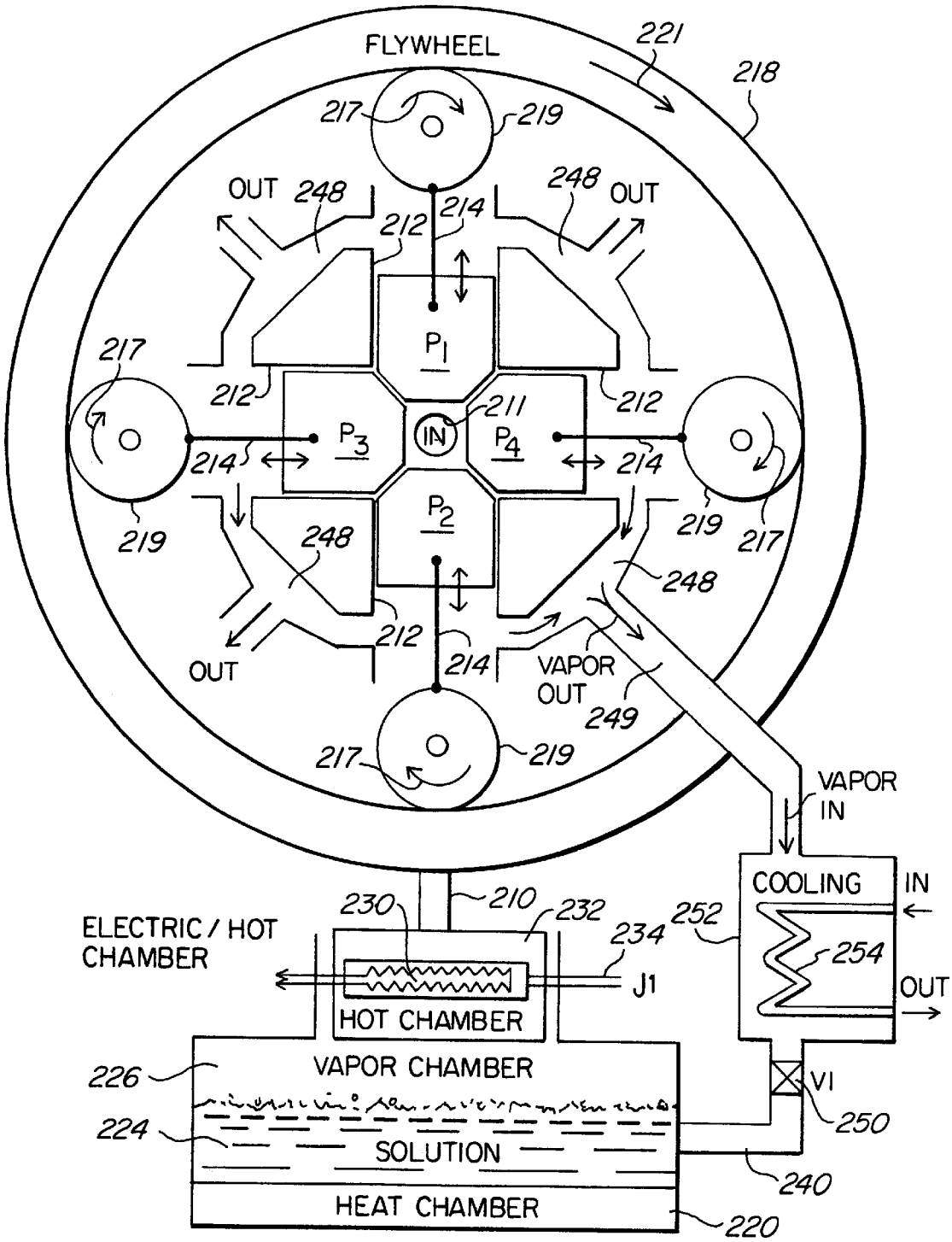
FIG. 3 schematically illustrates another embodiment of the present invention.

FIG. 3 illustrates another embodiment of the present invention. This embodiment combines a heat engine, similar to that illustrated in FIG. 1, to a piston and flywheel assembly. The heat engine comprises a heat chamber 220 and a vapor chamber 226 having a solution or liquid 224 therein. A hot or expansion chamber 232 is associated with vapor chamber 226. Placed within expansion chamber 232 are electric coils 230. Adjacent to electric coils 230 is an injector 234. The injector 234 injects a liquid into the expansion chamber 232. The injector 234 may be coupled to a return tube 240. Return tube 240 is coupled, through a valve 250, to a cooling chamber 252. Cooling chamber 252 has cooling coils 254 therein. Cooling chamber 252 is coupled to a tube 249. A pressure input tube 210 is coupled to the expansion chamber 232 and provides vapor pressure to the piston and flywheel assembly. Pressure input tube opening 211 provides vapor pressure to a plurality of pistons $P_1$, $P_2$, $P_3$,and $P_4$. The vapor pressure causes pistons $P_1$, $P_2$, $P_3$, and $P_4$ to move within respective cylinders 212. A rod 214 connects each of the pistons $P_1$, $P_2$, $P_3$, and $P_4$ to a respective crank wheel 219. This causes the crank wheels 219 to rotate in the direction of arrows 217. Crank wheels 219 in turn cause flywheel 218 to rotate in the direction of arrow 221. Flywheel 218 may be connected to a generator or load to do work. Each of the cylinders 212 is coupled to an exhaust port 248. Each of the exhaust ports 248 is coupled to tube 249, which returns vapor to cooling chamber 252.

Figure 4A:
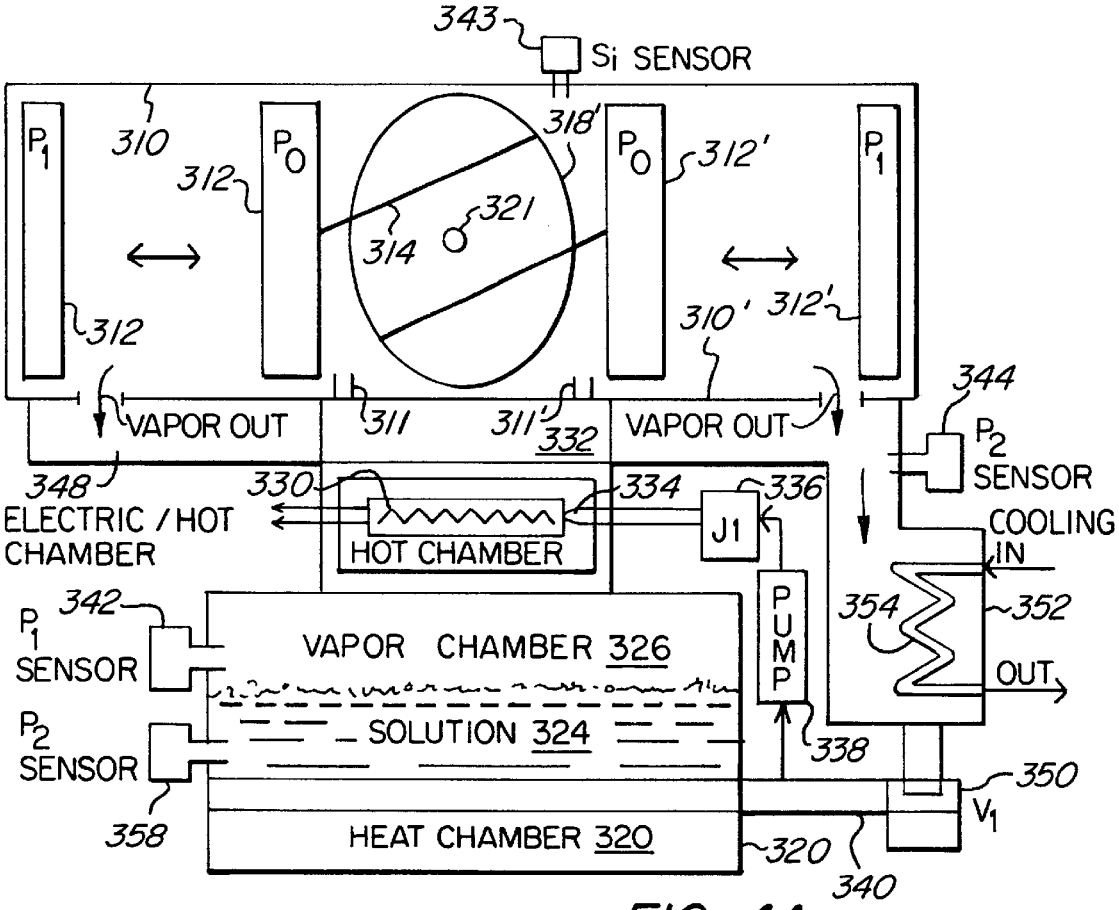
FIG. 4A schematically illustrates another embodiment of the present invention.

FIG. 4A illustrates yet another embodiment of the present invention. In this embodiment a heat engine is connected to another piston and flywheel assembly. The heat engine illustrated in FIG. 4A is similar to the heat engine illustrated in FIG. 1 and FIG. 3. Heat chamber 320 heats a solution or liquid 324 in a vapor chamber 326. A temperature sensor 358 monitors the temperature of the liquid 324. A pressure sensor 342 monitors the pressure in vapor chamber 326. Coils 330 are placed within an expansion chamber 332. An injector 336 and nozzle 334 are used to inject a portion of condensed liquid 324 into the coils 330. Pump 338 is coupled to a tube 340, which in turn is coupled to liquid 324 in heat chamber 320 and valve 350. Valve 350 controls the flow of condensed liquid from cooling chamber 352. Cooling chamber 352 has coils 354 therein. Cooling chamber 352 is coupled to exhaust port 348. Pressure sensor 344 monitors the pressure within the exhaust port 348.

The expansion chamber 332 is coupled to a first cylinder 310 through a first pressure inlet tube 311 and a second cylinder 310' through a second pressure inlet tube 311'. A first piston 312 and a second piston 312', initially in a first position $P_0$, are forced to a second position $P_1$ due to the pressure introduced by the pressure inlet tubes 311 and 311'. The pistons 312 and 312' are connected by rods 314 and 314' to crank wheels, respectfully. The crank wheels are not illustrated in FIG. 4A. The crank wheels rotate on shaft 321. The crank wheels are coupled to flywheels, with only flywheel 318' being illustrated in FIG. 4A.

Figure 4B:
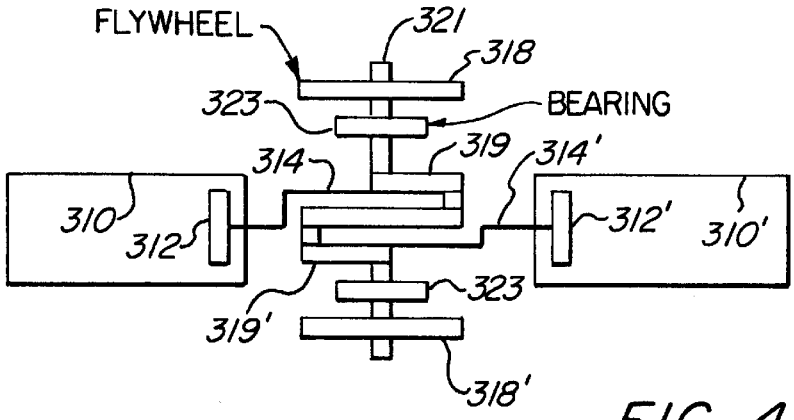
FIG. 4B schematically illustrates a plan view of the embodiment illustrated in FIG. 4A.

FIG. 4B is a plan view illustrating the piston flywheel assembly illustrated in FIG. 4A. FIG. 4B more clearly illustrates the connection between the pistons 312 and 312' and the crank wheels 319 and 319' and the flywheels 318 and 318' on shaft 321. Shaft 321 is held by bearings 323.

The operation of this embodiment can readily be appreciated with reference to FIGS. 4A and 4B. Liquid 324 is heated to a first temperature in vapor chamber 326. Liquid injected into a chamber containing electric coils 330 causes a higher pressure in expansion chamber 332. The high pressure vapor passes through inlet tubes 311 and 311' causing pistons 312 and 312' to move. This results in rotational energy being formed and stored in flywheels 318 and 318'. This rotational energy can then be used for any desired purpose. The vapor is exhausted through exhaust port 348 and delivered to cooling chamber 352 where it is condensed to liquid repeating the cycle.

All of the embodiments of the present invention provide a heat engine that utilizes a low boiling point liquid or solution and is a closed system. Therefore, energy and the low boiling point liquid are not lost. This permits the cycle to be repeated continuously. The use of a low boiling point liquid requires low energy, with the electric coils and injection of liquid providing a boost of pressure in the expansion chamber. This provides a quicker reaction time to an increase pressure requirement.

Accordingly, the present invention provides an improved heat engine and means for providing power or work. The heat engine of the present invention is an efficient closed system that utilizes a low boiling point liquid.

Although several preferred embodiments have been illustrated and described, it will be obvious to those skilled in the art that various modifications may be made without departing form the spirit and scope if this invention.

What is claimed is:

1. A heat engine comprising:

a first chamber, whereby a low boiling point liquid selected from a group consisting of freon, alcohol, and ether is heated to a first temperature;

a second chamber coupled to said first chamber and selectively heated to a second temperature, the second temperature being higher than the first temperature;

a cylinder coupled to said second chamber; and a piston place within said cylinder, whereby when a liquid is injected into said second chamber a vapor is formed within said cylinder.

2. A heat engine as in claim 1 further comprising:

a condenser coupled to said cylinder and said first chamber, whereby gas is condensed into a liquid and returned to said first chamber.

3. A heat engine as in claim 1 further comprising:

a temperature sensor coupled to said first chamber; and a pressure sensor coupled to said first chamber.

4. A heat engine as in claim 1 wherein:

said first chamber is heated by solar energy.

5. A heat engine as in claim 1 further comprising:

a flywheel coupled to said piston; and a generator coupled to said flywheel.

6. A heat engine comprising:

a heat chamber;

a vapor chamber adjacent said heat chamber;

a liquid placed in said vapor chamber, said liquid having a boiling point below one hundred degrees Celsius;

a high temperature chamber placed in said vapor chamber;

electric coils placed in said high temperature chamber;

at least four radially disposed cylinders coupled to said high temperature chamber and said vapor chamber;

at least four radially disposed pistons, one each of said at least four radially disposed pistons placed within each of said at least four radially disposed cylinders;

a flywheel coupled to said piston;

a rod coupled to each of said at least four radially disposed pistons;

a crank wheel connected to each of said rods, said crank wheel positioned so as to contact an inside surface of said flywheel, whereby said crank wheels are caused to rotate causing said flywheel to rotate;

an exhaust port coupled to each of said at least four radially disposed cylinders;

a cooling chamber coupled to said exhaust port, whereby gas from each of said at least four radially disposed cylinders is returned and condensed into said liquid;

a return tube coupled to said cooling chamber and said vapor pressure chamber;

a pump coupled to said return tube; and an injector coupled to said pump and said high temperature chamber, whereby the liquid is injected into said high temperature chamber.

7. A heat engine as in claim 6 wherein:

said liquid is selected from a group consisting of freon, alcohol, and ether.

8. A heat engine as in claim 6 wherein:

said heat chamber is heated by solar energy.

9. A heat engine comprising:

a liquid having a boiling point less than water;

means for heating said liquid to a first temperature creating a gas;

means, placed within said means for heating said liquid to a first temperature, for heating said liquid to a second temperature, said second temperature being higher than said first temperature;

means, coupled to said means for heating said liquid to a first temperature, for performing work with the gas; and means, coupled to said means for performing work, for condensing the gas to said liquid and returning said liquid to said means for heating said liquid to a first temperature, whereby said liquid is heated forming a gas to do work and the gas is condensed forming liquid in a closed cycle.

10. A heat engine as in claim 9 wherein:

said liquid is selected from a group consisting of freon, alcohol, and ether.

11. A heat engine comprising:

a heat chamber;

a source of heat, whereby said heat chamber is heated to a first temperature;

a vapor chamber adjacent said heat chamber;

a liquid placed in said vapor chamber, said liquid having a boiling point below one hundred degrees Celsius;

a high temperature chamber placed in said vapor chamber;

electric coils placed in said high temperature chamber;

a cylinder coupled to said high temperature chamber and said vapor chamber;

a piston placed within said cylinder;

a flywheel coupled to said piston;

an exhaust port coupled to said cylinder;

a cooling chamber coupled to said exhaust port, whereby vapor from said cylinder is returned and condensed into said liquid;

a return tube coupled to said cooling chamber and said vapor pressure chamber;

a valve coupled to said return tube between said cooling chamber and said vapor chamber;

a pump coupled to said return tube;

an injector coupled to said pump and said high temperature chamber, whereby said liquid is injected into said high temperature chamber;

a temperature sensor placed adjacent said liquid;

a high pressure sensor coupled to said vapor chamber;

a low pressure sensor coupled to said exhaust port;

a piston position sensor coupled to said piston; and an electronic control, said electronic control coupled to said heat chamber, said temperature sensor, said high pressure sensor, said low pressure sensor, said piston position sensor, and said valve, whereby an efficient closed cycle is utilized to perform work.

12. A method of using an expanding gas to do work comprising the steps of:

heating a liquid in a first chamber, the liquid selected from a group consisting of freon, alcohol, and ether;

heating a second chamber;

injecting the liquid into the second chamber creating a gas, the second chamber being hotter than the first chamber;

expanding the gas to do work; and condensing the gas and returning the liquid to the first chamber.

13. A heat engine comprising:

a first chamber containing a low boiling point liquid;

a heat chamber placed adjacent said first chamber and heating the low boiling point liquid to a first temperature creating a vapor pressure;

a second chamber coupled to said first chamber;

an electric coil placed within said second chamber, wherein said second chamber is selectively heated to a second temperature, the second temperature being higher than the first temperature;

an injector adjacent said second chamber, said injector injecting the low boiling point liquid into said second chamber;

a cylinder coupled to said second chamber;

a cylinder top closing one end of said cylinder;

a piston place within said cylinder, said piston having a high pressure side adjacent said second chamber and a low pressure side adjacent said cylinder top, an exhaust port placed in said cylinder, said exhaust port having a position adjacent said cylinder top such that the exhaust port is open to the low pressure side of said piston;

a condenser coupled to said exhaust port and said injector, whereby said condenser causes a low pressure to be formed on the low pressure side of said piston when vapor is condensed by said condenser and the low boiling point liquid is returned to said first chamber and said injector;

a return tube coupled to said first chamber, said condenser, and said exhaust port;

a valve placed within said return tube, whereby when said valve is open pressure on the low pressure side and the high pressure side of said piston are equalized;

a high pressure sensor coupled to said first chamber;

a low pressure sensor coupled to said exhaust port; and a control coupled to said valve, said high pressure sensor, and said low pressure sensor, whereby said valve is selectively opened, whereby when the low boiling point liquid is injected into said second chamber a vapor is formed moving said piston within said cylinder as a result of a high pressure on the high pressure side of said piston and a low pressure on the low pressure side of said piston.

* * * * *